US005229560A

United States Patent [19]

DeMarco

[11] Patent Number: 5,229,560

[45] Date of Patent: Jul. 20, 1993

[54] VEHICLE DOOR-JAMB SWITCH ASSEMBLY

[76] Inventor: Stephen R. DeMarco, Rte. 3, Box 376-M, Clinton, N.C. 28328

[21] Appl. No.: 925,024

[22] Filed: Aug. 5, 1992

[51] Int. Cl.[5] ..... H01H 3/16

[52] U.S. Cl. ..... 200/61.7

[58] Field of Search ..... 200/61.62, 61.69, 61.7, 200/61.76–61.78, 61.81, 61.82

[56] References Cited

U.S. PATENT DOCUMENTS

| | | | |
|---|---|---|---|
| 595,963 | 12/1897 | McCaughey | 200/61.82 |
| 1,836,452 | 12/1931 | Day | 200/61.66 |
| 1,902,195 | 3/1933 | Swahn | 200/61.7 X |
| 2,206,102 | 7/1940 | Meuer | 200/61.7 |
| 3,659,063 | 4/1972 | Peterson | 200/61.7 |
| 3,729,603 | 4/1973 | Foltz | 200/61.7 |
| 4,406,935 | 9/1983 | Montag et al. | 200/61.82 |

*Primary Examiner*—J. R. Scott

*Attorney, Agent, or Firm*—Rhodes, Coats & Bennett

[57] ABSTRACT

The present invention relates to a vehicle door jamb switch assembly for transmitting electrical current through opposing door jambs that form a part of the vehicle door assembly. The door jamb switch assembly of the present invention includes a first jamb switch assembly that is disposed within one door jamb and includes a series or spaced apart spring loaded conductor pins. A second jamb switch assembly is provided in the opposing door jamb and is provided with a plurality of spaced apart contact plates that are designed to engage with the respective conductor pins of the first switch assembly when the door assembly assumes a closed position.

9 Claims, 3 Drawing Sheets

VEHICLE DOOR-JAMB SWITCH ASSEMBLY

FIELD OF THE INVENTION

The present invention relates to vehicles and to door jamb switches assemblies for use in vehicles.

BACKGROUND OF THE INVENTION

There is a growing popularity in the United States in vehicle kits used to make hobby vehicles. A variety of different vehicle kits are available to construct many different styles of vehicles including hot rods and antique-looking vehicles. Vehicle kits include customized vehicle parts that enable an individual to hand assemble customized vehicles having state-of-the-art features. One important state of the art feature of many of the customized vehicles is powered windows, door locks, etc.

To supply the powered windows and door locks with electricity, electricity from the vehicle's battery must be conducted across a hinge space located between the door jambs. The spacing between the door jambs varies as the vehicle door is opened and closed. When the vehicle door is closed, the hinge space, or the space between the door, is often formed by only a small amount of clearance between the opposing door jambs. When the vehicle door is opened, the door's closing edge or jamb pivots away from the opposing door post, causing the size of the hinge space to increase.

Due to the varying size of the jamb spacing and the limited size of the jamb space when the vehicle door is closed, the manual installation and operation of powered window has proven to be problematic. The prior art method used to conduct electricity across the hinge space is to run wires across the hinge space. The wires running across the hinge or jamb space must be of a length sufficient to cross the hinge space while the door is in an open position. When the vehicle door is closed, the size of the hinge space is decreased and there is an excess length of wire in the hinge space that must have space to collect. The need to store excess wire while the door is closed necessitates a hinge space of sufficient size to collect the excess wire. Therefore, vehicles must be designed with a large clearance between the door jambs. In addition, even if the size of the hinge space is sized to collect the excess wire formed when the door is closed, the wires still have a tendency to tangle and scratch other vehicle components.

Some vehicle doors do have a switch used to control the flow of electricity through the wires passing through the hinge space. These prior art switches operate to allow electricity to flow through the wires while the door is closed, but open the circuit when the vehicle door is opened. These prior art switches still require wires to pass through the hinge space. In addition prior art switches require precise alignment of the moving switch components that mate. Such prior art switching devices require precise tolerances between the mating switch components. In addition, prior art switches often are excessively large and have the potential to scratch other parts of the vehicle during the opening and closing of the vehicle door.

SUMMARY OF THE INVENTION

The present invention vehicle door-jam switch solves problems of the prior art by eliminating the need to use wires to conduct electricity across the hinge space. The door-jamb switch of the present invention includes a post switch assembly mounted on the door post and a mating door edge switch assembly mounted on the edge of the vehicle door. The post switch assembly has a recessed frame that includes a series of spaced apart and spring loaded contact pins that are moveable between a retracted and an extended position. These contact pins extend outwardly from the door post when the door is open and have a wire connected to each contact pin. The mating door edge switch assembly includes recessed contact plates that are mounted on a recessed frame. The contact plates are exposed and face outwardly from the door edge and have wires connected thereto.

When the vehicle door is in an open position, the contact pins of the post switch assembly do not contact the contact plates of the door edge switch. As the vehicle door closes, the contact plates are pivoted or moved towards the contact pins and engage the contact pins to make an electrical contact. As the contact plates move forward against the contact pins, the springs enable the contact pins to retract as the door closes.

The design of the vehicle door switch allows a vehicle door to be designed with limited clearance between the door edge and the door post, and without the need for precise tolerances for the electrical contact to be made. In particular, both the post switch assembly frame and the door edge switch assembly frame are embedded within the respective same areas. Likewise, the contact plates are embedded within the containing frame structure. Furthermore, the contact pins are spring loaded such that they are depressed into the door post as engaging contact is made.

Accordingly, it is an object of the present invention to provide a vehicle door-jamb switch that conducts electricity through a hinge space or jamb in a vehicle door without the need of wires passing through the hinge space.

Another object of the present invention is to provide a vehicle door switch that allows for limited clearance between the door jambs when the vehicle is closed.

Another object of the present invention is to provide a vehicle door switch that does not have to be precisely aligned in order to properly conduct electricity through the door switch.

Another object of the present invention resides in the provision of a vehicle door-jamb switch that is reliable, dependable and which is easy to maintain.

Still a further object of the present invention resides in the provision of a door-jamb switch that comprises a basic design that is capable of being embodied within a molded, plastic frame structure.

Other objects and advantages of the present invention will become apparent and obvious from a study of the following description and the accompanying drawings which are merely illustrative of such invention.

DETAILED DESCRIPTION OF THE INVENTION

Figure 1:
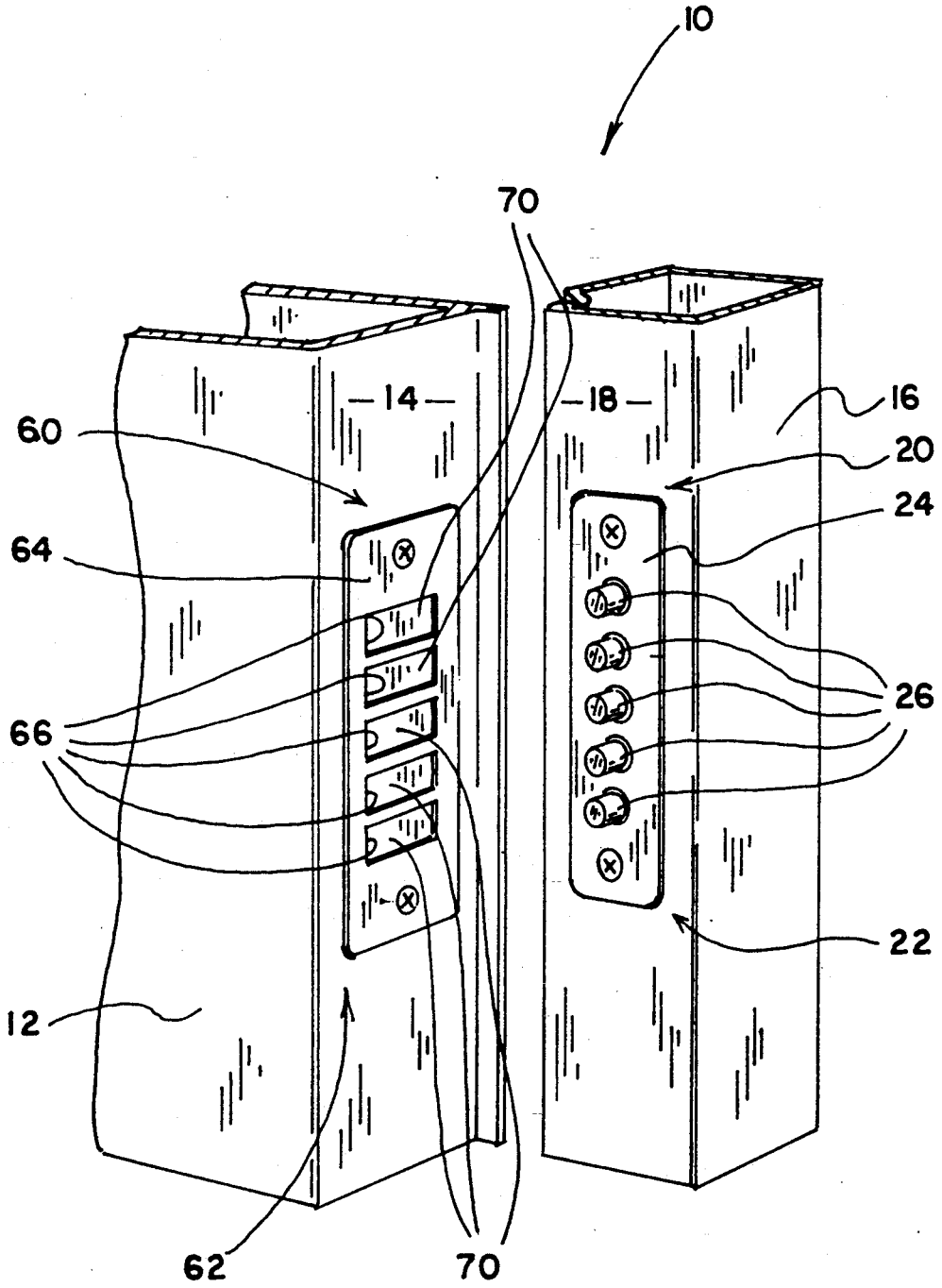
FIG. 1 is a perspective view illustrating the door-jamb switch of the present invention incorporated into a pair of opposing door jambs.

With further reference to the drawings, the door jamb switch of the present invention is shown therein and indicated generally by the numeral 10. As seen in the drawings, door-jamb switch 10 is specifically designed and suited for use in a vehicle door assembly of the type having a door 12 with a jamb or closing edge 14 and a fixed post or frame 16 also including a jamb surface 18. It should be pointed out, however, that the door switch assembly 10 of the present invention may be utilized in other applications besides the automotive field. For purposes of this disclose, the door-jamb switch assembly 10 will be discussed in the context of a vehicle and particularly the vehicle door assembly comprised of the door 12 and fixed post 16 shown in FIG. 1.

Door-jamb switch contact assembly 10 basically comprises a fixed post or fixed jam switch 20 and a door-jamb switch contact assembly 60.

First in viewing the fixed post or fixed jamb switch contact assembly 20 it is seen that the same is incorporated into the fixed post 16 of the vehicle. Fixed jamb switch contact assembly 20 includes a frame structure indicated generally by the numeral 22. Frame structure assembly 22 includes a face plate 24 that is typically mounted in a recessed fashion within the jamb 18 of the fixed post 16. Face plate 24 includes a series of vertically spaced apart openings 26 formed therein. Extending rearwardly from each opening 26 is a sleeve 28 that includes an open cylindrical area 30 formed therein. Formed about the rear of the open cylinder 30 is a back wall 32. While the frame structure 22 that forms a part of the fixed jamb switch contact assembly 20 can be constructed of various materials, it is contemplated that one material particularly suitable for the switch would be molded plastics.

Disposed within each of the sleeves 28 is a spring-loaded pin assembly indicated generally by the numeral 34. As will be appreciated from subsequent portions of this disclosure, the spring-loaded pins 34 are biased to assume an extended position where each pin 34 projects a selected distance outwardly from the base plate 24 (FIG. 1). However, because of the spring loaded nature of the pins 34, they are retracted back through the sleeves 28 by their engagement with door-jamb switch contact assembly 60 when the door 12 assumes a closed position. Viewing each of the pins 34 in more detail, it is seen that each pin 34 includes a contact head 36 that is disposed adjacent to the jamb 18. Opposite contact head 36 is a current transmitting end 38. It is noted that the current transmitting end 38 is of a smaller diameter than the contact head 36 and that there is formed a shoulder that forms a transition between the contact head 36 and the current transmitting end 38.

A coil spring 40 surrounds the current transmitting end portion 38 of the pin 34 between the contact head 36 and the back wall 32 of each pin sleeve 28. As noted in FIG. 2, the springs 40 bias the respective pins 34 to the left or to an extended position. The pins 34 shown in FIG. 1 assume an extended position while the pins in FIG. 2 assume a retracted position.

Figure 2:
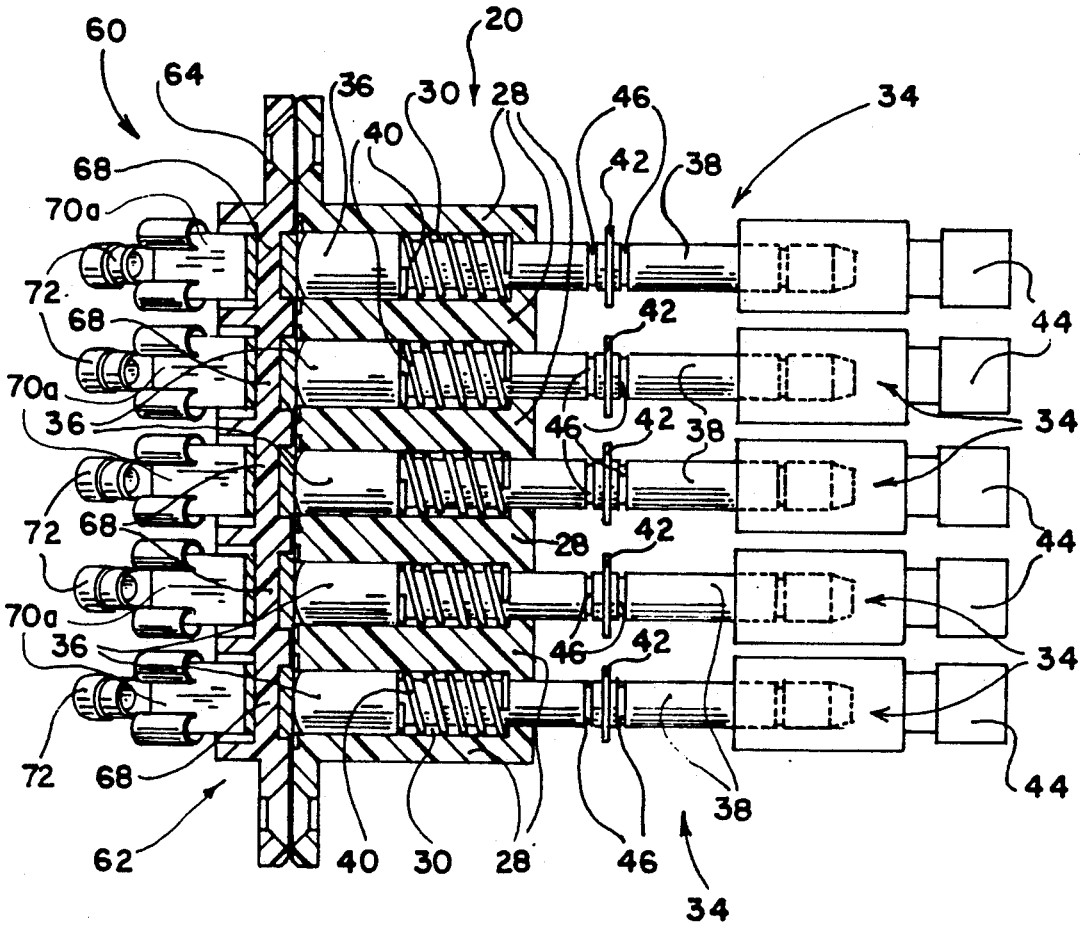
FIG. 2 is a vertical cross-sectional view of the door-jamb switch of the present invention shown with the door of the vehicle closed and the respective switch components in a closed and mating position.

To limit the extension of the respective pins 34, there is provided an O-type stop ring 42 that is connected to the shaft of the current transmitting end portion 38 just to the right of the back wall 32 of the pin sleeve 28, as viewed in FIG. 2. As noted, the stop ring 42 is simply an O-type stop ring that surrounds and is held in place on the current transmitting end 38 by a series of O-ring slots 46 formed in the current transmitting end 38. Thus, the degree of extension of the respective contact heads 36 can be adjusted by placing the stop ring 42 in selected slots 46 formed in the current transmitting end 38.

In order to connect various electrical wires leading to the fixed jamb switch assembly 20, respective current transmitting end portions 38 are provided with a wire attaching clip 44.

Figure 3:
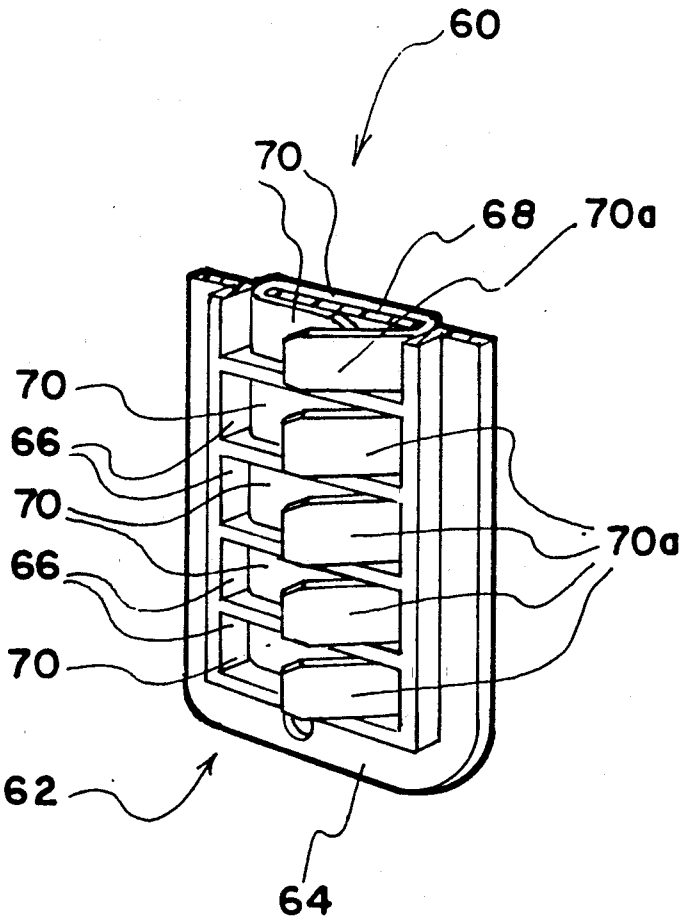
FIG. 3 is a perspective fragmentary view of the moveable door-jamb contact switch assembly that illustrates how the respective contact plates are bent around the recess face of that switch component.

Now turning to the door jamb switch contact assembly indicated generally by the numeral 60, it is seen that the same is incorporated into door jamb 14. Door jamb switch contact assembly 60 includes a frame structure indicated generally by numeral 62. Although both switch frame structures 22 and 62 can be constructed of various types of materials, it is contemplated that one suitable material for the frame structures 22 and 62 is that of a molded plastic. Frame structure 62 of the door jamb switch contact assembly 60 includes a face plate 64 that is mounted in a recessed fashion in door jamb 14 and has a series of openings 66 formed therein. Each opening is formed by a recess plate support 68 that is integrally formed into the frame structure 62 with each plate support 68 being recessed with respect to the face plate 64. A series of contact plates 70 are provided for the recessed opening 66 formed in the door jamb switch contact assembly 60. As seen in FIG. 2 and FIG. 3, each respective contact plate 70 is essentially bent and angled around the plate support 68 and includes a tail portion **70*a* that projects interiorally from the door jamb switch contact assembly 60 and is designed to accept wire clip 72**.

Therefore, in operation, when the door 12 is in the open position, the respective pins 34 project outwardly through face plate 24 and are exposed as shown in FIG. 1. As the door 12 is closed, it is appreciated that the swinging or moving door-jamb switch 60 will eventually move into close proximity with the fixed post jamb 18. In any event, the respective plate 70 of the door jamb switch will easy clear the edge of the fixed post 16. As the door continues to pivot towards a closed position, the contact plates 70 will each engage respective aligned spring-loaded pins 34. Once the contact plates 70 have engaged the pins 34, the continued closing of the door 12 will result in the spring-loaded pins 34 being pushed into the post 16 of the vehicle. Once door 12 has been actually closed, as shown in FIG. 2, the contact heads 36 of the spring-loaded pins 34 will project into engagement with the contact plates 70 to form a closed-switch assembly. Note that the springs 40 continue to exert a biasing force or action towards the left as viewed in FIG. 2, causing the contact heads 36 to engage and be held against the contact plates 70 of the door jamb switch 60. Thus, in the door closed position shown in FIG. 2, it is appreciated that electrical circuit can be transmitted through the opposing door jambs 14 and 18 and routed to the electric windows, electric door locks and the like.

The opening of door 12, however, results in a break or opening within the switch 10. In this case, the contact plates 70 are swung or moved away from the fixed jamb switch 20 to cause the contact heads 36 to be projected outwardly and out of contact with contact plates 70.

From the foregoing specification and discussion, it is seen that the present invention entails a very efficient door-jamb switch assembly 10 that can be applied in vehicle door jambs and other related structures. The door-jamb switch assembly 10 of the present invention is very effective and efficient in creating a switch assembly in opposing door jambs of a vehicle. Because of the nature of the present design, the tolerances associated with the door-jamb switch assembly 10 of the present invention do not have to be extremely tight as the design itself incorporates flexibility and there does not have to be precise alignment in order for contact to be made and the entire switch assembly to be closed. Also, the very nature of the door-jamb switch assembly design enables the same to be recessed or embedded slightly within the respective jambs 14 and 18 and consequently are particularly suitable for use in vehicle door assemblies where the clearance between the opposing jambs is minimum. Also, the nature of this design enables the door 12 to be swung freely about the fixed post or frame 16 without fear that a portion of the door jamb switch will engage and scratch or scar an associated structure of the vehicle or door 12.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A vehicle door-jamb switch for transmitting electrical current directly through a vehicle-door jamb assembly including a door-jamb and fixed-door post and a swingable door, comprising:

(a) a non-moveable post switch contact assembly mountable within the fixed-door post and including;
  (1) a frame structure;
  (2) a series of spaced apart and spring loaded contact pins mounted within the frame structure and moveable between a retracted position and an extended position,
  (3) wire connecting means secured to the spring loaded contact pins for conducting current;

(b) a moving cooperating door edge switch contact assembly mountable within a closing edge of the vehicle door and operative to mate with the post switch assembly to form a closed switch when the vehicle door assumes a closed position, the door edge switch comprising:
  (1) a frame structure adapted to be secured within the edge of a door;
  (2) recessed contact support means carried by the frame structure;
  (3) a series of spaced apart contact plates secured within the frame structure about the recessed contact support means with the respective contact plates being exposed and facing outwardly from the door edge; and
  (4) wire connecting means secured to respective contacts for directing current to and from the door edge switch; and (c) wherein the contacts formed in the door edge are operative to be swung into lateral sliding contact with the spring-loaded contact pins projecting outwardly from the fixed door post such that when the door assumes a closed position, the respective contacts of the post switch assembly and the cooperating door-edge switch connect to form a closed switch within the door post area of the vehicle such that the electrical current can be readily transferred through both the post switch assembly and the door-edge switch assembly.

2. The vehicle door-jamb switch of claim 1 wherein the frame structure of the post-switch contact assembly includes a face plate having a series of openings formed therein, and a series of pin sleeves extending from respective openings in the face plate, and wherein the spring-loaded pins are mounted within the respective pin sleeves of the frame structure.

3. The vehicle door-jamb switch of claim 2 wherein each pin includes a contact head that extends outwardly from the face plate when the pin assumes an extended position.

4. The vehicle door-jamb switch of claim 3 wherein each pin includes a current transmitting end portion opposite the contact head; and wherein there is provided spring biasing means confined within each pin sleeve and engaged with each pin for biasing the contact head of each pin outwardly towards the extended position.

5. The vehicle door-jamb switch of claim 4 including means for limiting the outward movement of the respective pins to a fully extended position where the contact head of each pin extends a selected distance outwardly from the face plate of the frame structure of the post switch assembly.

6. The vehicle door-jamb switch of claim 5 wherein the means for limiting the outward movement of the contact pin includes a ring stop formed on the contact pin outside of the pin sleeve such that as the pin moves outwardly towards the extended position, the ring stop engages the pin sleeve causing the pin to stop and be stationed at the fully extended position due to the engagement of the ring stop with the pin sleeve.

7. The vehicle door-jamb switch of claim 1 wherein the contact plates of the door-edge switch contact assembly are bent around the recessed contact-support means carried by the frame structure of the door edge switch assembly.

8. The vehicle door-jamb switch of claim 7 wherein the frame structure of the door-edge switch contact assembly includes a face plate and wherein the contact plates are sufficiently recessed such that the contact plates do not project outwardly beyond the face plate of the frame structure of the door-edge switch assembly.

9. The vehicle door-jamb switch contact assembly for transmitting electrical current through opposing and facing door jambs of a door assembly comprising:

(a) a first stationary switch assembly mounted in one door jam and including a series of spaced apart contact pins movably mounted between a retracted position and an extended position;

(b) biasing means engaged with the contact pins for moving the contact pins from the retracted position to the extended position;

(c) wire connecting means secured to the contact pins for conducting current to and from the first switch assembly;

(d) a second moveable switch contact assembly mounted in the other opposing door jamb and cooperative with the first switch assembly to form a closed switch when the door assembly is closed such that current can effectively be transferred through the door jambs of the door assembly;

(e) the second switch assembly including a series of spaced apart contact plates with the plates being spaced apart to correspond to the spacing between the respective contact pins such that when the door assembly is closed, the respective contact plates will engage the contact pins and move the respective contact pins from the extended position towards the retracted position and wherein when the door assembly assumes a closed state, the respective contact plates will engage the respective contact pins; and (f) wire connecting means secured to the respective contact plates for transmitting current to and from the second switch assembly.

* * * * *